US011680497B2

(12) United States Patent
Stretch

(10) Patent No.: US 11,680,497 B2
(45) Date of Patent: Jun. 20, 2023

(54) OIL COOLING FOR ELECTROMAGNETIC LATCH HOUSED IN ROCKER ARM

(71) Applicant: Eaton Intelligent Power Limited, Dublin (IE)

(72) Inventor: Dale Arden Stretch, Novi, MI (US)

(73) Assignee: Eaton Intelligent Power Limited, Dublin (IE)

( * ) Notice: Subject to any disclaimer, the term of this patent is extended or adjusted under 35 U.S.C. 154(b) by 130 days.

(21) Appl. No.: 17/415,843

(22) PCT Filed: Dec. 20, 2019

(86) PCT No.: PCT/EP2019/025479

§ 371 (c)(1),
(2) Date: Jun. 18, 2021

(87) PCT Pub. No.: WO2020/126102

PCT Pub. Date: Jun. 25, 2020

(65) Prior Publication Data

US 2022/0074322 A1 Mar. 10, 2022

Related U.S. Application Data

(60) Provisional application No. 62/784,300, filed on Dec. 21, 2018.

(51) Int. Cl.

| | |
|---|---|
| ***F01L 1/18*** | (2006.01) |
| ***F01L 1/46*** | (2006.01) |
| *F01L 1/24* | (2006.01) |

(52) U.S. Cl.

CPC ..... *F01L 1/185* (2013.01); *F01L 1/46* (2013.01); *F01L 1/2405* (2013.01); (Continued)

(58) Field of Classification Search

CPC ..... F01L 1/185; F01L 1/46; F01L 2810/01; F01L 2820/031; F01L 2001/186; F01L 1/2405; F01L 2001/2444

(Continued)

(56) References Cited

U.S. PATENT DOCUMENTS

| | | | |
|---|---|---|---|
| 6,354,253 B1 | 3/2002 | Katsumata et al. | |
| 2019/0257227 A1 | 8/2019 | McCarthy, Jr. et al. | |

FOREIGN PATENT DOCUMENTS

| | | | | |
|---|---|---|---|---|
| EP | 1002938 A2 * | 5/2000 | ..... | F01L 1/24 |
| WO | WO-2016028812 A1 * | 2/2016 | ..... | F01L 1/185 |
| WO | WO-2017156125 A2 * | 9/2017 | ..... | F01L 1/185 |

OTHER PUBLICATIONS

International Search Report and Written Opinion for PCT/EP2019/025479, dated Mar. 30, 2020; pp. 1-9.

* cited by examiner

*Primary Examiner* — Jorge L Leon, Jr.
(74) *Attorney, Agent, or Firm* — Baker Botts L.L.P.

(57) ABSTRACT

A valvetrain includes a rocker arm assembly having a rocker arm and an electromagnetic latch assembly. An electromagnet of the latch assembly is housed within a chamber formed by the rocker arm. Passageways suitable for oil cooling of the electromagnet are formed through and inside the rocker arm. In some embodiments, oil for cooling is supplied through a pivot. In some embodiments, oil for cooling is obtained from oil splash. Oil cooling may allow modes of operation such as of dynamic cylinder deactivation and dynamic variable valve actuation to be used without overheating the electromagnet.

16 Claims, 6 Drawing Sheets

(52) U.S. Cl.
CPC . *F01L 2001/186* (2013.01); *F01L 2001/2444* (2013.01); *F01L 2810/01* (2013.01); *F01L 2820/031* (2013.01)

(58) Field of Classification Search
USPC ..... 123/90.36, 90.41, 90.43, 90.44
See application file for complete search history.

OIL COOLING FOR ELECTROMAGNETIC LATCH HOUSED IN ROCKER ARM

FIELD

The present teachings relate to valvetrains, particularly valvetrains providing variable valve lift (VVL) or cylinder deactivation (CDA).

BACKGROUND

Hydraulically actuated latches are used on some rocker arm assemblies to implement variable valve lift (VVL) or cylinder deactivation (CDA). For example, some switching roller finger followers (SRFF) use hydraulically actuated latches. In these systems, pressurized oil from an oil pump may be used for latch actuation. The flow of pressurized oil may be regulated by an oil control valve (OCV) under the supervision of an engine control unit (ECU). A separate feed from the same source provides oil for hydraulic lash adjustment. In these systems, each rocker arm assembly has two hydraulic feeds, which entails a degree of complexity and equipment cost. The oil demands of these hydraulic feeds may approach the limits of existing supply systems.

Complexity and demands for oil in some valvetrain systems can be reduced by replacing hydraulically latched rocker arm assemblies with rocker arm assemblies having electromagnetic actuators. Providing electromagnetic actuators for rocker arm assembly latches presents packaging issues. It has been found that an electromagnetic latch assembly can be fit inside a rocker arm and that doing so lends itself to solving the packaging problem. The present disclosure relates to improvement for valvetrains in which electromagnetic actuators are installed within rocker arms.

SUMMARY

The present teachings relate to a valvetrain for an internal combustion engine of a type that has a combustion chamber and a moveable valve having a seat formed in the combustion chamber. The valvetrain includes a camshaft, an electromagnetic latch assembly, and a rocker arm assembly. The rocker arm assembly may include a cam follower configured to engage a cam mounted on the camshaft as the camshaft rotates. The electromagnetic latch assembly may include a latch pin translatable between a first position and a second position and an electromagnet. One of the first and second latch pin positions may provide a configuration in which the rocker arm assembly is operative to actuate the moveable valve in response to rotation of the camshaft to produce a first valve lift profile. The other of the first and second latch pin positions may provide a configuration in which the rocker arm assembly is operative to actuate the valve in response to rotation of the camshaft to produce a second valve lift profile, which is distinct from the first valve lift profile, or may deactivate the valve. The rocker arm assembly includes a rocker arm that forms a chamber that houses the electromagnet. The rocker arm includes a load-bearing structure and the chamber is formed within the load bearing structure. In some of these teaching the rocker arm is formed from a single piece of metal that may be cast or stamped.

In accordance with the present teachings, passageways suitable for oil cooling of the electromagnet are formed through and inside the rocker arm. Some of the passageways may allow oil to enter the rocker arm and some of the passageways may allow oil to exit the rocker arm. Some of the passageways may allow oil to flow adjacent to the electromagnet inside the rocker arm.

In some of these teachings, the valvetrain includes a pivot that provides a fulcrum for the rocker arm assembly. In some of these teachings, oil for cooling the electromagnet is provided to the interior of the rocker arm through the pivot. In some of these teaching, the rocker arm has a surface that interfaces with the pivot. In some of these teachings, that surface has a gothic profile. In some of these teachings, the passageways comprise an opening onto the surface of the rocker arm that interfaces with the pivot. In some of these teaching, the opening is connected to an opening in the chamber that houses the electromagnet by a straight passage.

A cooling oil flow rate may be regulated by the friction factor of the passages. In some of these teachings, the passageways have a friction factor that results in a flow rate in the range from 0.005 to 0.06 liters per minute when provided with a source of SAE 10W30 motor oil at 100° C. at a pressure of 40 psi. If the flow rate of oil is too great, the demand on the oil supply system may be excessive. If the flow rate of oil is too low, cooling may be insufficient. In some of these teaching, a passage between the gothic and the chamber provides the primary contribution to this friction factor. In other words, the passage from the gothic to the chamber may be sized to regulate the flow of cooling oil. In some of these teachings, that passage is narrow. In some of these teaching, that passage has a diameter of 2 mm or less. In some of these teaching, that passage has a diameter of 1 mm or less. This is narrower than a passage that would be used for hydraulic latch actuation.

In those teachings where oil for cooling the electromagnet is provided through the pivot, the pivot may have an oil passage with an opening at an end of the pivot that provides the fulcrum for the rocker arm assembly. The cam has a cam cycle. When the latch pin is in one of the first position and the second position cam periodically lifts the rocker arm for a part of the cam cycle. In some of these teachings, the opening of the oil passage in the pivot communicates with the opening in the surface of the rocker arm during one part of the cam cycle but does not communicate substantially with the opening in the surface of the rocker arm during another part of the cam cycle. In some of these teachings, substantial communication take place only when the rocker arm is being lifted by the cam. These features may be used to help regulate the flow of cooling oil.

In some of these teachings, the oil for cooling is obtained from oil splash around the rocker arm assembly. In some of these teachings, the passageways comprise an opening in an upper surface of the rocker arm. Gravity may assist in moving oil into the rocker arm through that opening. In some of these teaching, a retention area is formed on the surface of the rocker arm to direct oil toward an opening in the surface of the rocker arm, which may be an opening on the upper surface of the rocker arm. In some of these teachings, the retention area includes a concave structure. In some of these teachings, the retention area includes a dam.

In some of these teachings, the electromagnet is contained within a housing that is installed within the chamber in the rocker arm. In some of these teachings, the oil flow passages comprise space that is outside the housing but within the chamber. Such space allows oil to flow across the surface of the housing. In some of these teachings, one or more opening are formed in the housing to allow oil to flow into and out of the housing. This brings the oil into more immediate proximity with the electromagnet.

Some of the present teachings relate to retrofitting a hydraulically latched rocker arm assembly with an electromagnetic latch assembly. The rocker arm may have been designed and put into production for use with a hydraulically actuated latch. Rocker arms for commercial applications are typically manufactured using customized casting and stamping equipment requiring a large capital investment. In some of the present teachings, the rocker arm is one that was designed to house a hydraulically actuated latch and includes a hydraulic chamber, which is the chamber within which the electromagnet is installed.

In some aspects of the present teachings, the electromagnetic latch assembly provides the latch pin with positional stability independently from the electromagnet when the latch pin is in the first position and when the latch pin is in the second position. This dual positional stability enables the latch to retain both latched and unlatched states without continuous power to the electromagnet. In these teachings, the electromagnet does not need to be powered or operative on the latch pin except during latch pin actuation, which reduces the extent to which cooling bay be required.

Some aspects of the present teachings relate to a method of operating a valvetrain. According to the method, an electromagnet of an electromagnetic latch assembly is operated inside a rocker arm of the rocker arm assembly, generating heat inside the rocker arm. Oil is flowed through the rocker arm to remove some of that heat. In some of these teachings, the oil removes the majority of the heat generated by the electromagnet over a period. In some of these teachings, the oil has a flow rate through the rocker arm that is in the range from 0.005 to 0.06 liters per minute over a significant period. In some of these teachings, the flow of oil is drawn from a pivot providing a fulcrum for the rocker arm assembly. In some of these teachings the flow of oil is drawn from oil splash around the rocker arm assembly.

The foregoing systems and methods may allow the electromagnetic latch assembly to be used in providing one or more of dynamic cylinder deactivation and dynamic variable valve actuation. These require a frequency of operation that may not be feasible without oil cooling. In some of these teachings, the electromagnet is operated in a way that would heat the electromagnet to a temperature in excess of 200° C. absent the flow of oil through the rocker arm and the flow of oil through the rocker arm keeps the electromagnet at temperatures below 190° C. In some of these teachings, the electromagnet is operated with a duty cycle of 5% or more and the flow of oil through the rocker arm provides a steady state temperature below 190° C. for the electromagnet. In some of these teaching the duty cycle is 20% or more and the flow of oil through the rocker arm still provides a steady state temperature below 190° C. for the electromagnet.

The primary purpose of this summary has been to present broad aspects of the present teachings in a simplified form to facilitate understanding of the present disclosure. This summary is not a comprehensive description of every aspect of the present teachings. Other aspects of the present teachings will be conveyed to one of ordinary skill in the art by the following detailed description together with the drawings.

DETAILED DESCRIPTION

Figure 1:
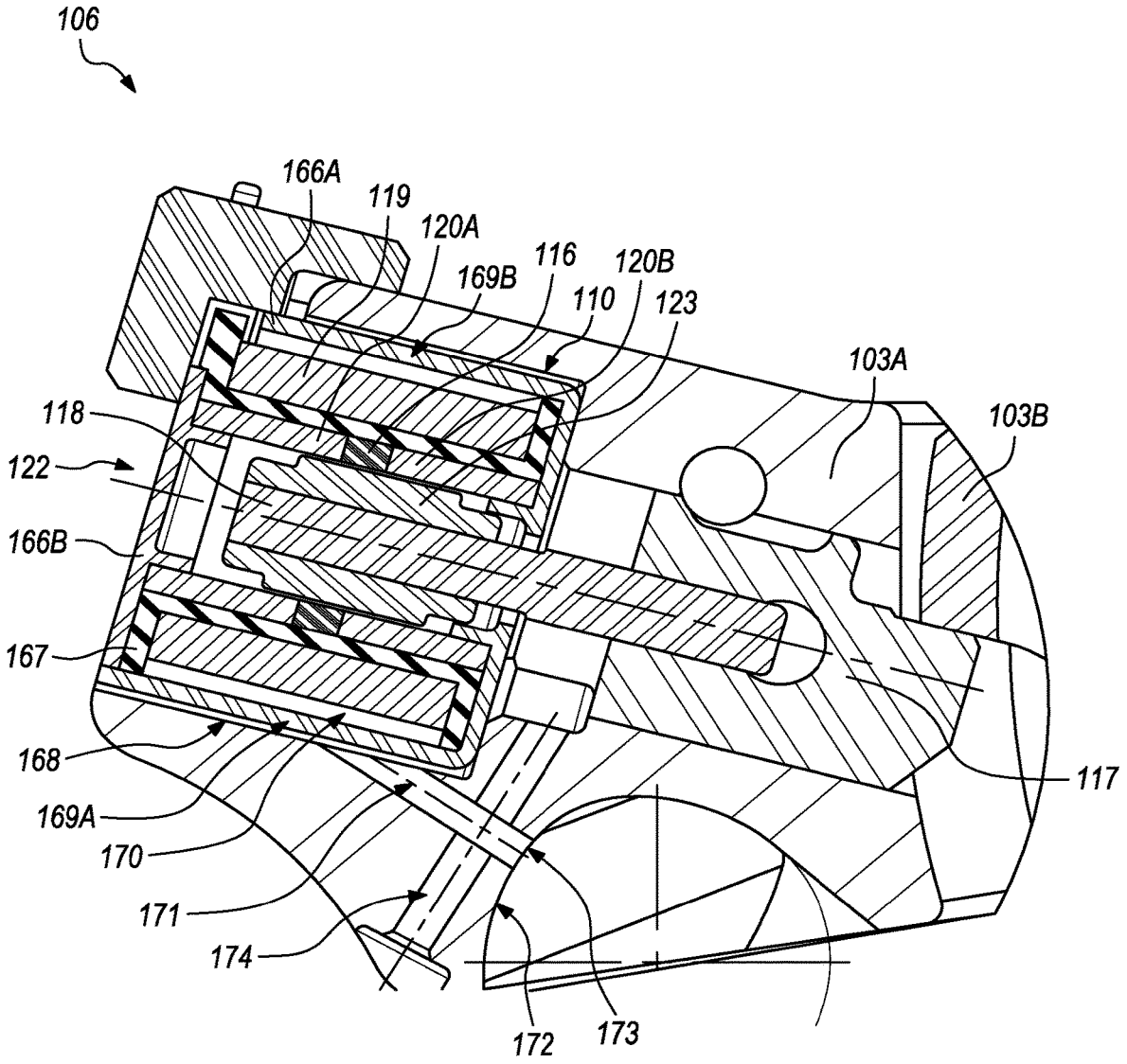
FIG. 1 is a cross-sectional side view of a portion of a rocker arm assembly according to some aspects of the present teachings.

In the drawings, some reference characters consist of a number with a letter suffix. In this description and the claims that follow, a reference character consisting of that same number without a letter suffix is equivalent to a listing of all reference characters used in the drawings and consisting of that same number with a letter suffix. For example, "rocker arm 103" is the same as "rocker arm 103A, 103B, 103C".

Figure 2:
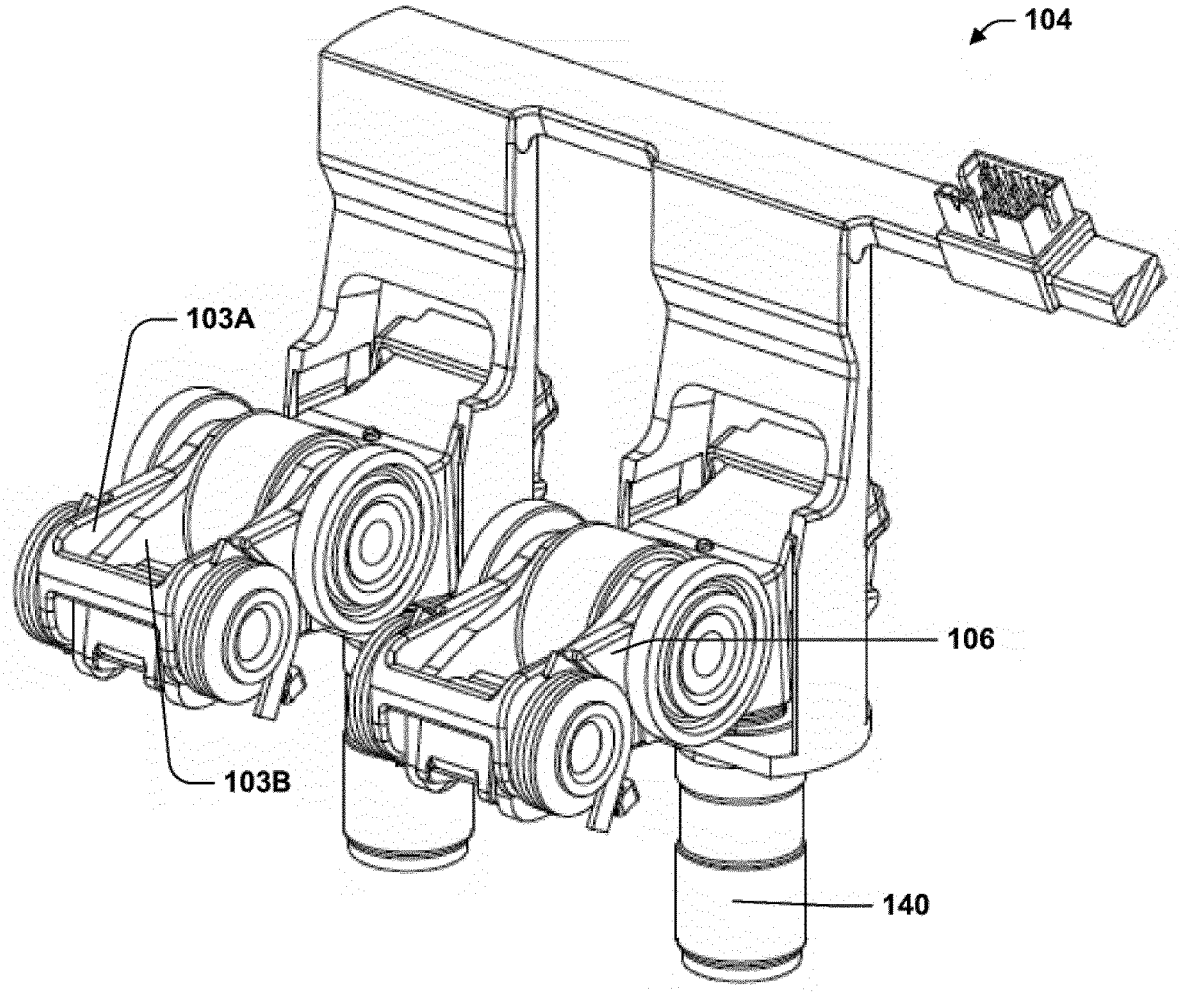
FIG. 2 is a perspective view of a portion of a valvetrain that include two of the rocker arm assemblies illustrated in FIG. 1.
Figure 3:
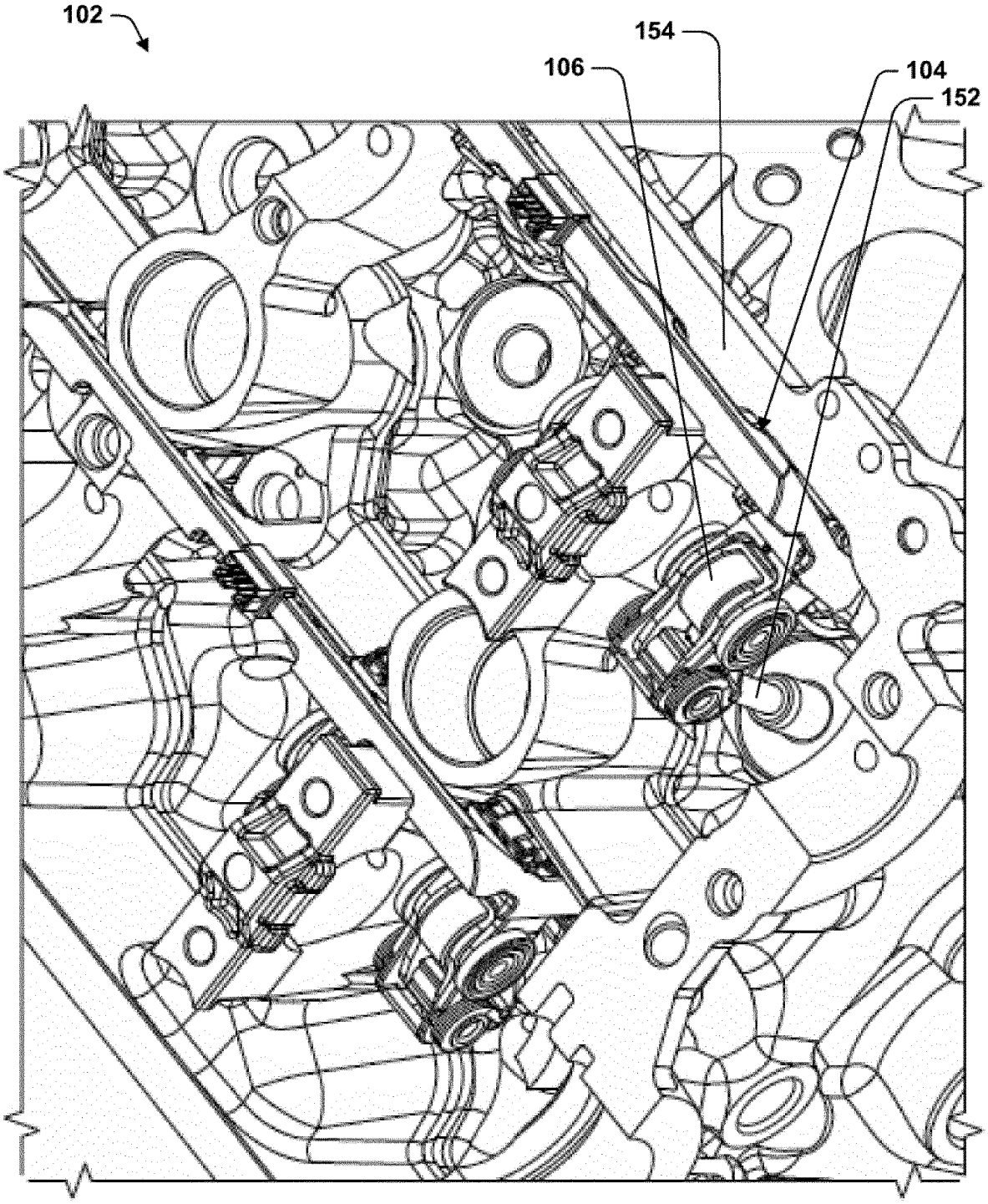
FIG. 3 provides a perspective view with some components removed of an engine including the valvetrain illustrated by FIG. 2.

FIGS. 1-3 illustrate an internal combustion engine 102 including a valvetrain 104 and rocker arm assemblies 106. FIG. 1 is a cutaway view of a rocker arm assembly 106. Rocker arm assembly 106 includes an outer arm 103A, an inner arm 103B, a cam follower 111, and an electromagnetic latch assembly 122. FIG. 2 is a perspective of a portion of valvetrain 104 including two rocker arm assemblies 106 and a power transfer module 241 that provides power to electromagnetic latch assemblies 122. FIG. 3 illustrates portions of valvetrain 104 installed on the cylinder head 154 of engine 102. Additional parts of valvetrain 104 include poppet valves 152 (a type of moveable valve), a camshaft (not shown) on which are mounted cams (not shown), and pivots 140. Cam followers 111 are configured to engage and follow cams on the camshaft as the camshaft rotates.

With reference to FIG. 1, electromagnetic latch assembly 122 includes a latch pin 117 translatable between extended and retracted positions. FIG. 1 shows latch pin 117 in the extended position. In the extended position, outer arm 103A and inner arm 103B are engaged by latch pin 117. In the retracted position, outer arm 103A and inner arm 103B are disengaged and inner arm 103B may be actuated by a cam without moving outer arm 103A. Pivot 140 sits within a bore formed in cylinder head 154 and provides a fulcrum for rocker arm assembly 106. Poppet valve 152 has a seat within cylinder head 154.

Outer arm 103A includes a gothic 172, which is a surface having a gothic profile. Gothic 172 is shaped to interface with pivot 140, whereby pivot 140 provides a fulcrum on which rocker arm assembly 106 pivots when latch pin 117 is in the engaging position and outer arm 103A is being lifted by a cam through cam follower 111.

Electromagnetic latch assembly 122 includes an electromagnet 119 formed by a coil of wire that may be wound about bobbin 167. Electromagnet 119 acts on ferrule 123, which is formed of ferromagnetic material. The magnetic force on ferrule 123 is transferred to latch pin 117 through core 118, which is paramagnetic.

Electromagnetic latch assembly 122 also includes permanent magnets 120A and 120B, which are arranged with confronting polarities and are operative to stably maintain latch pin 117 in both extend and retracted position. Permanent magnets 120 remain in fixed positions relative to electromagnet 119 and outer arm 103A even as latch pin 117 translates between extended and retracted positions. Permanent magnets 120 operate through magnet circuits formed in part by a pole piece 116 positioned between magnets 120 and a housing 166 that encloses electromagnet 119. Housing 166 is formed of ferromagnetic material and includes two parts, a cup-shaped part 166A and a cap 166B. Parts of electromagnetic latch assembly 122 including housing 166 are installed within a chamber 110 formed in outer arm 103A. Providing electromagnetic latch assembly 122 with dual positional allows electromagnetic latch assembly 122 with only intermittent power. If electromagnet 119 were powered continuously, it would be more susceptible to overheating.

Passages for oil cooling of electromagnet 119 are formed through and inside rocker arm 103A. These include a space 168 between housing 166 and the limits of chamber 110. In the illustrated example, space 168 in is formed by giving housing 166 an inward bow. Space 168 may alternatively be formed in any suitable manner, including for example enlarging chamber 110 above what is required to accommodate housing 166 or by forming channels in housing 166 or the edges of chamber 110. The space 168 is not required.

Figure 4:
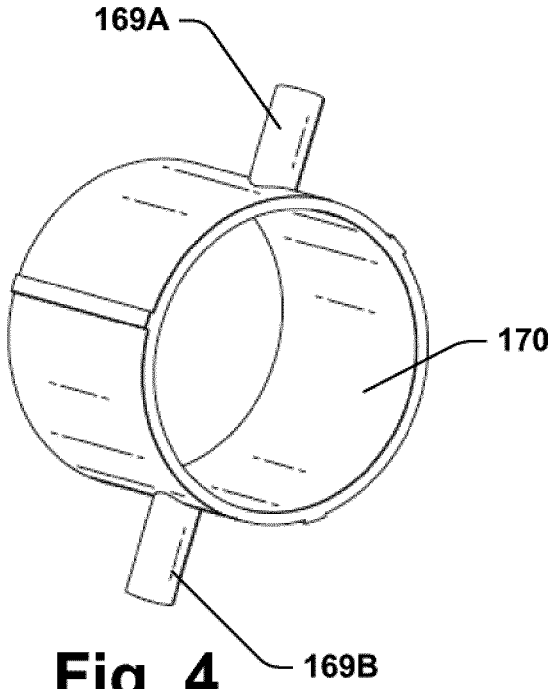
FIG. 4 is a perspective view of some of the oil passages in a rocker arm according to the present teachings.

Passages for oil cooling of electromagnet 119 may also include openings 169A and 169B in housing 166, which allow oil to flow in and out of a space 170 within housing 166 surrounding and adjacent to electromagnet 119. The shape of passages formed by openings 169 and space 170 are illustrated in FIG. 4.

With reference to FIG. 1, passages for oil cooling of electromagnet 119 may also include passage 171, which extends from an opening 173 on gothic 172 to chamber 110. Passage 171 is offset from passage 174, which is a drain that facilitates free movement of latch pin 117. Passage 171 may convey a supply of oil from pivot 140 for cooling electromagnet 119.

Figure 5:
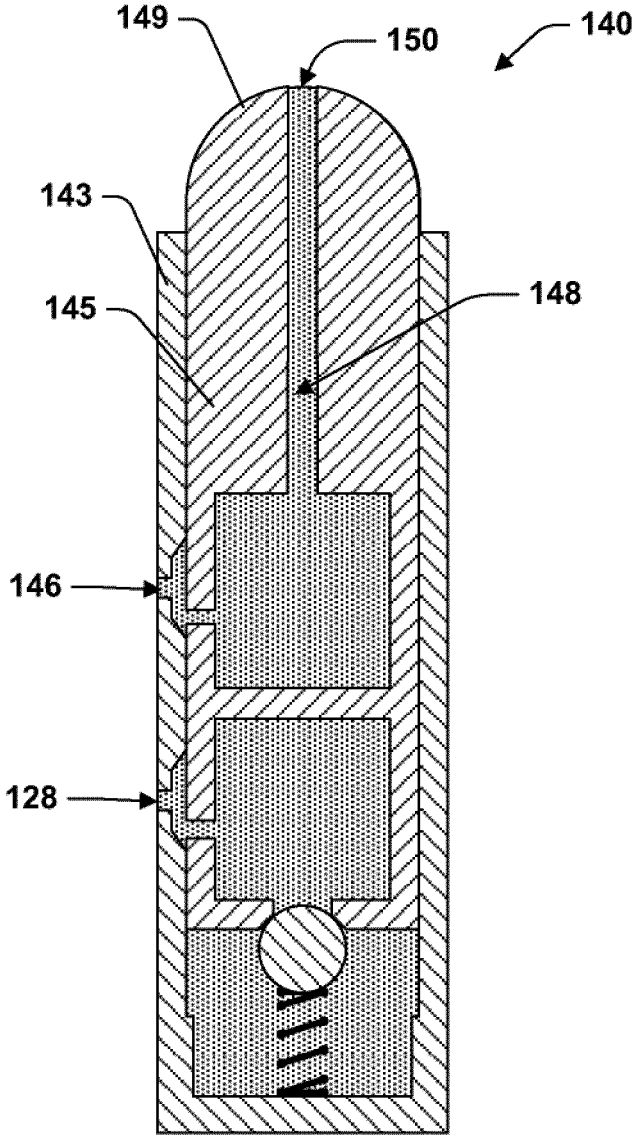
FIG. 5 provides a cutaway view of a hydraulic lash adjuster that may be used in the present teachings.

FIG. 5 illustrates a pivot 140 suitable for providing oil for cooling electromagnet 119 through gothic 172. Pivot 140 may be a hydraulic lash adjuster with an oil feed 128 for lash adjustment and an oil feed 146 for supplying oil to the rocker arm assembly 106. Pivot 140 has an end 149 that provides a fulcrum for rocker arm assembly 106 and has a shape that mates with gothic 172. End 149 has an opening 150. Pivot 140 has an inner sleeve 145, an outer sleeve 143, and internal passages 148 providing communication between oil feed 128 and opening 150 in end 149.

The interface between end 149 and gothic 172 may be substantially oil tight and provide communication between opening 173 in outer arm 103A and opening 150 in pivot 140. This communication may be continuous or may depend on the pivot angle of outer arm 103A on pivot 140. For example, opening 173 may be positioned such that opening 150 communicates with opening 172 only when outer arm 103A is being lifted by a cam. A substantial degree of communication is one that permits oil to flow in amounts that are effective for cooling. An amount effective for cooling is generally at least 0.005 liters per minute.

Pivot 140 may provide oil to outer arm 103A at a pressure in the range from 35 to 45 psi. To provide adequate cooling without placing excessive demands on an oil pump, it is desirable to provide outer arm 103A with cooling oil at a flow rate in the range from 0.005 to 0.06 liters per minute. Adequate cooling keeps electromagnet 119 at a temperature of 200° C. or less. Given the supply pressure and the physical properties of the oil, the flow rate of the oil will be determined by the friction factor of the passages by which the oil flows through outer arm 103A. The flow rate of oil may be limited by making passage 171 sufficiently narrow that it accounts for most of the friction factor. A sufficiently narrow passage will generally be 2 mm or less in diameter. Typically, passage 171 will be 1 mm or less in diameter. For example, passage 171 may be 0.8 mm in diameter.

Figure 6:
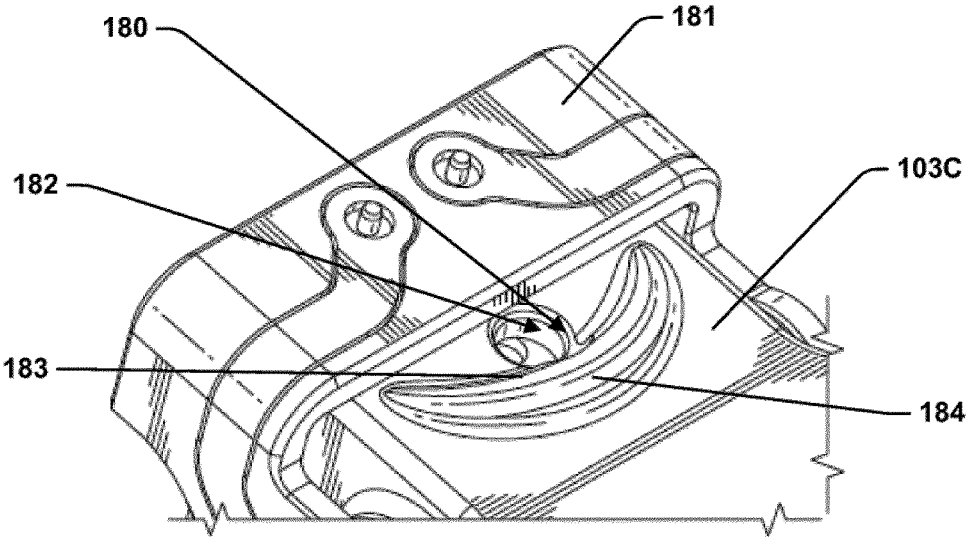
FIG. 6 is a top view showing a portion of a rocker arm according to the present teachings.
Figure 7:
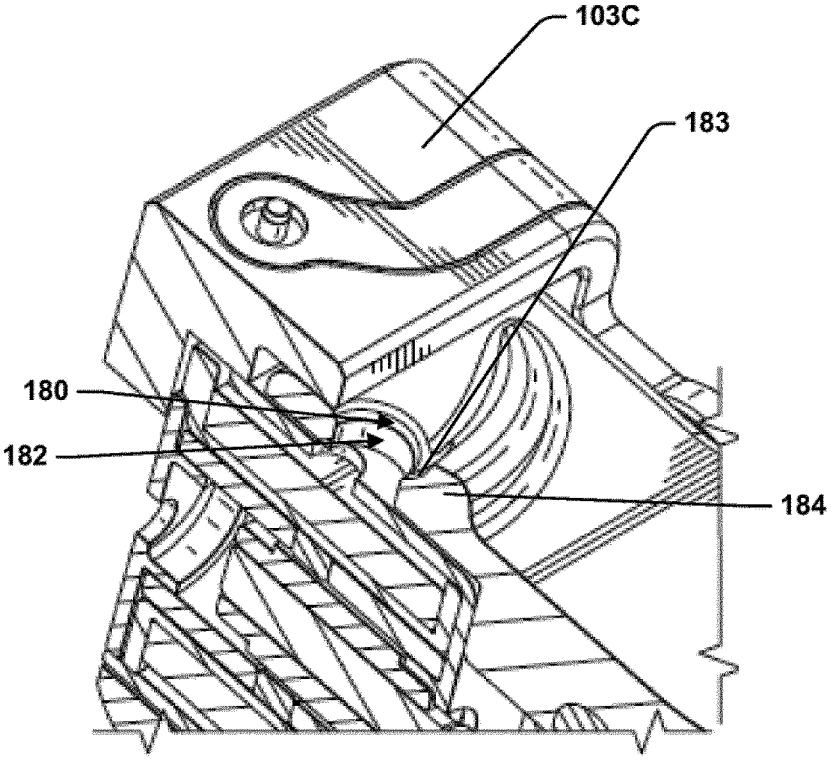
FIG. 7 is a cutaway view showing a portion of the rocker arm of FIG. 6.

FIGS. 6 and 7 illustrate an outer arm 103C that may be used in place of outer arm 103A to provide oil cooling of electromagnet 119 using oil splash in the environment around rocker arm assembly 106. Rocker arm 103C has an opening 182 formed in its upper surface to allow oil to enter outer arm 103C. Another opening (not shown may be formed at the bottom of outer arm 103C to allow the oil to drain out. Hole 182 may have a chamfered edge 180 to facilitate the admission of oil. A dam 184, which is a raised structure on the outer surface of outer arm 103C, may be positioned to direct oil splash toward opening 182. Dam 184 has a concave surface 183 to moving oil toward opening 182. Frame 181, which is a structure provided on outer arm 103C that provides electrical connections for powering electromagnet 119, may also provide a dam that directs oil splash toward hole 182. Frame 181 and dam 184 form a retention area that directs oil toward hole 182

Electromagnetic latch assembly 122 provides both extended and retracted positions in which latch pin 117 is stable. As a consequence, either the latched or unlatched configuration can be reliably maintained without electromagnet 119 being powered. Positional stability refers to the tendency of latch pin 117 to remain in and return to a particular position. Stability is provided by restorative forces that act against small perturbations of latch pin 117 from a stable position. In electromagnetic latch assembly 122, stabilizing forces are provided by permanent magnets 120.

In accordance with some aspects of the present teachings, electromagnet 119 is powered by circuitry (not shown) that allows the polarity of a voltage applied to electromagnet 119 to be reversed. A conventional solenoid switch forms a magnetic circuit that include an air gap, a spring that tends to enlarge the air gap, and an armature moveable to reduce the air gap. Moving the armature to reduce the air gap reduces the magnetic reluctance of that circuit. As a consequence, energizing a conventional solenoid switch causes the armature to move in the direction that reduces the air gap regardless of the direction of the current through the solenoid's coil or the polarity of the resulting magnetic field. Latch pin 117 of electromagnetic latch assembly 122, however, may be moved in either one direction or another depending on the polarity of the magnetic field generated by electromagnet 119. Circuitry, an H-bridge for example, that allows the polarity of the applied voltage to be reversed enables the operation of electromagnetic latch assembly 122 for actuating latch pin 117 to either an extended or a retracted position.

Figure 8:
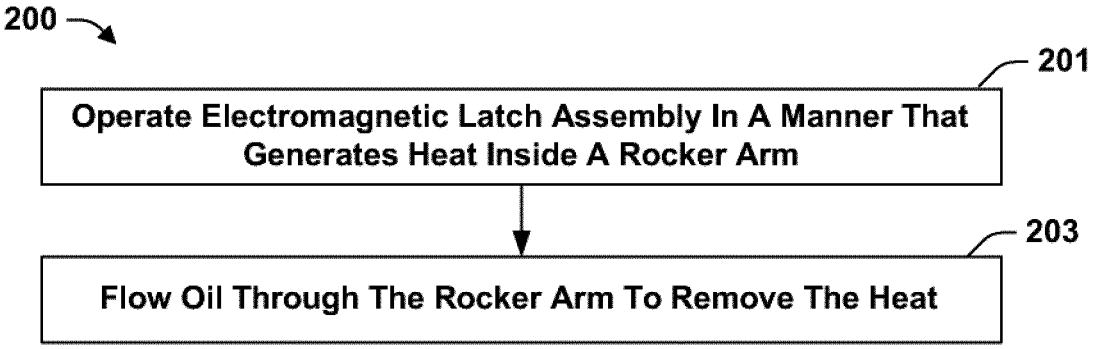
FIG. 8 is a flow chart of a method of operating a valvetrain according to some aspects of the present teachings.

FIG. 8 provides a flow chart of a method 200 according to some aspects of the present teachings that may be used to operate valvetrain 104 in engine 102. Method 200 begins with action 201, operating electromagnet 119 in a manner that generates heat inside rocker arm 103. That manner may include a duty cycle of at least 5%, optionally 20% or more. That manner may meet the requirements of dynamic cylinder deactivation or dynamic variable valve actuation. That manner may be one that would generate so much heat that electromagnet 119 would heat to an excessive temperature, such as a temperature greater than 200° C., absent oil cooling.

Method 200 continues with act 203, flowing oil through the rocker arm 103 to remove heat. In some embodiments, the oil flow is provided through a pivot that provides a fulcrum for rocker arm assembly 106. In some embodiments, the oil is provided by oil splash. In some embodiments, the oil has a flow rate through rocker arm 103 that remains in the range from 0.005 to 0.06 liters per minute over a significant period, such as a period sufficient to prevent a temperature excursion over 200° C. In some embodiments, the oil removes a majority of the heat generated by operating the electromagnet 119. In some of these teaching, the oil flow rate is sufficient to keep electromagnet 119 at a temperature of 190° C. or less.

The components and features of the present disclosure have been shown and/or described in terms of certain teachings and examples. While a particular component or feature, or a broad or narrow formulation of that component or feature, may have been described in relation to only some aspects of the present teachings or some examples, all components and features in either their broad or narrow formulations may be combined with other components or features to the extent such combinations would be recognized as logical by one of ordinary skill in the art.

The invention claimed is:

1. A valvetrain for an internal combustion engine of a type that has a combustion chamber, a moveable valve having a seat formed in the combustion chamber, and a camshaft, the valvetrain comprising:

a rocker arm assembly, comprising:

a rocker arm forming a chamber including an inward facing surface;

a plurality of oil passages including:

a first oil passage extending from the chamber and communicating with a first opening on a gothic surface of the rocker arm;

a second oil passage offset from the first oil passage; and an oil space between the housing and the inward facing surface of the chamber; and a cam follower configured to engage a cam mounted on the camshaft as the camshaft rotates;

a pivot including a pivot end surface that provides a fulcrum for the rocker arm assembly, the pivot end surface interfacing with the gothic surface having a gothic profile, the pivot further including a pivot oil passage communicating with a second opening on the pivot end surface;

a housing installed inside the chamber; and an electromagnetic latch assembly comprising an electromagnet contained inside the housing, and a latch pin configured to translate between a first position and a second position, wherein the second oil passage is a drain configured to facilitate free movement of the latch pin, wherein the cam is configured to have a cam cycle through which the cam periodically lifts the rocker arm, wherein the second opening on the pivot end surface of the pivot is configured to continuously communicate with the first opening on the gothic surface of the rocker arm during a first part of the cam cycle, and wherein the second opening does not continuously communicate with the first opening during a second part of the cam cycle.

2. The valvetrain of claim 1, wherein the oil space between the housing and the inward facing surface of the chamber is formed by channels in the inward facing surface of the chamber or an outward facing surface of the housing.

3. The valvetrain of claim 1, wherein the chamber is a retrofit hydraulic chamber.

4. The valvetrain of claim 1, wherein the gothic surface of the rocker arm comprises a concave surface with the gothic profile.

5. The valvetrain of claim 1, wherein the first oil passage includes a diameter of 2 mm or less so as to restrict oil flow from the pivot to the oil space.

6. The valvetrain of claim 1, wherein the first part of the cam cycle corresponds to a period in which the rocker arm is being lifted by the cam.

7. A method of operating the valvetrain of claim 1, the method comprising:

generating heat inside the rocker arm by operating the electromagnet; and flowing oil through the plurality of oil passages so as to remove a portion of the heat.

8. A valvetrain for an internal combustion engine of a type that has a combustion chamber, a moveable valve having a seat formed in the combustion chamber, and a camshaft, the valvetrain comprising:

a rocker arm assembly, comprising:

a rocker arm forming a chamber including an inward facing surface;

a gothic surface having a gothic profile of the rocker arm and a first opening; and a cam follower configured to engage a cam mounted on the camshaft as the camshaft rotates;

a pivot including a pivot end surface comprising a second opening, and a pivot oil passage, wherein the pivot oil passage communicates with the second opening on the pivot end surface;

a housing installed inside the chamber, the housing comprising a plurality of ports configured to communicate an oil flow into and out of the chamber, at least one port of the plurality of ports communicating with the first opening on the gothic surface of the rocker arm via a first oil passage of a plurality of oil passages; and an electromagnetic latch assembly comprising an electromagnet contained inside the housing, and a latch pin configured to translate between a first position and a second position, wherein the plurality of oil passages further includes a second oil passage offset from the first oil passage, the second oil passage is a drain configured to facilitate free movement of the latch pin, wherein the second opening on the pivot end surface of the pivot is configured to communicate with the first opening on the gothic surface of the rocker arm only when the rocker am is being lifted by the cam.

9. A method of operating the valvetrain of claim 8, the method comprising:

generating heat inside the rocker arm by operating the electromagnet; and flowing oil through the plurality of ports so as to remove a portion of the heat.

10. The valvetrain of claim 8, wherein the chamber is a retrofit hydraulic chamber.

11. The valvetrain of claim 8, wherein the first oil passage includes a diameter of 2 mm or less so as to restrict the communication between the first opening and the at least one port.

12. The valvetrain of claim 8, wherein the pivot provides a fulcrum for the rocker arm assembly.

13. A valvetrain for an internal combustion engine of a type that has a combustion chamber, a moveable valve having a seat formed in the combustion chamber, and a camshaft, the valvetrain comprising:

a rocker arm assembly comprising:

a rocker arm forming a chamber including an inward facing surface; and a cam follower configured to engage a cam mounted on the camshaft as the camshaft rotates;

an electromagnetic latch assembly comprising an electromagnet contained inside the chamber, and a latch pin configured to translate between a first position and a second position;

a first oil sage extending from an upper surface of the rocker arm into the chamber, the first oil passage configured to direct oil splash into the chamber; and a second oil passage in the rocker arm configured to direct the oil splash out of the chamber.

14. The valvetrain of claim 13, further comprising a retention area formed on the upper surface of the rocker arm that directs oil toward an opening of the first oil passage.

15. A method of operating the valvetrain of claim 13, the method comprising:

generating heat inside the rocker arm by operating the electromagnet; and removing a portion of the heat via the oil splash.

16. A rocker arm assembly, comprising:

a rocker arm forming a chamber including an inward facing surface;

a cam follower configured to engage a cam;

an electromagnetic latch assembly including an electromagnet contained inside the chamber and a latch pin configured to translate between a first position and a second position;

a first passage extending from an upper surface of the rocker arm into the chamber, the first passage configured to direct oil splash into the chamber; and a second passage in the rocker arm configured to direct the oil splash out of the chamber.

* * * * *